US007059556B2

(12) United States Patent
Johansson et al.

(10) Patent No.: US 7,059,556 B2
(45) Date of Patent: Jun. 13, 2006

(54) THREAD SUPPLYING DEVICE

(75) Inventors: Egon Johansson, Marbaeck (SE); Paer Josefsson, Boras (SE)

(73) Assignee: Iropa AG, Baar (CH)

( * ) Notice: Subject to any disclaimer, the term of this patent is extended or adjusted under 35 U.S.C. 154(b) by 82 days.

(21) Appl. No.: 10/468,632

(22) PCT Filed: Feb. 13, 2002

(86) PCT No.: PCT/EP02/01512

§ 371 (c)(1),
(2), (4) Date: Feb. 9, 2004

(87) PCT Pub. No.: WO02/066353

PCT Pub. Date: Aug. 29, 2002

(65) Prior Publication Data

US 2004/0108400 A1 Jun. 10, 2004

(30) Foreign Application Priority Data

Feb. 19, 2001 (DE) ..... 101 07 688

(51) Int. Cl.
*B65H 51/20* (2006.01)
*H02K 21/12* (2006.01)

(52) U.S. Cl. ..... 242/365.3; 242/365.6; 242/364.4; 310/156.01

(58) Field of Classification Search ..... 242/365.3, 242/365.7, 365.6, 364.4; 139/452
See application file for complete search history.

(56) References Cited

U.S. PATENT DOCUMENTS 4,116,397 A 9/1978 Burgbacher
4,936,356 A * 6/1990 Ghiardo ..... 139/452
5,181,544 A * 1/1993 Deiuri ..... 139/452
5,351,724 A * 10/1994 Zenoni et al. ..... 139/452
5,794,867 A 8/1998 Hermanns et al.
6,062,501 A * 5/2000 Halvarsson ..... 242/364.8
6,691,942 B1 * 2/2004 Josefsson et al. ..... 242/365.3
6,726,139 B1 * 4/2004 Persson ..... 242/365.3

FOREIGN PATENT DOCUMENTS

| | | |
|---|---|---|
| DE | 43 36 312 | 4/1995 |
| EP | 1 050 611 | 11/2000 |
| FR | 2 523 162 | 9/1983 |
| WO | WO 2004038907 A1 * | 5/2004 |

* cited by examiner

*Primary Examiner*—Kathy Matecki
*Assistant Examiner*—William E. Dondero
(74) *Attorney, Agent, or Firm*—Flynn, Thiel, Boutell & Tanis, P.C.

(57) ABSTRACT

A thread supplying device provided with a housing containing an electric motor wherein the stator is non-rotatingly mounted and the rotor is rotatingly mounted on a motor shaft. A thread guiding element is fixed to the motor shaft and a threader device which is fixed to the housing is also provided. When the motor shaft is in a set rotational position, the thread guiding element is physically associated with said threader device. A permanent magnet motor with pole cores provided with windings is integrated into the stator and permanent magnets are integrated into the rotor in such a way that the stator, rotor and the thread guiding element are arranged relative to the housing, in such a way that the motor shaft adopts the set position of rotation when the permanent magnet motor is devoid of electric current in a stable relative position of rotation, caused by magnetic forces, of the rotor in the stator.

12 Claims, 2 Drawing Sheets

THREAD SUPPLYING DEVICE

FIELD OF THE INVENTION

The invention relates to a thread supplying device.

BACKGROUND OF THE INVENTION

The electric motor of known thread supplying devices is an asynchronous motor needing complicated control electronics due its design and shows an operation performance which needs to accept some compromises when driving the thread guiding element of the thread supplying device. Among known thread supplying devices there are variants differing in equipment for threading of a new thread or even for automatically re-threading. When manually threading a new thread with a threading needle a guiding track provided in a housing bracket may be used for the threading needle in order to bring the new thread towards the withdrawal area. In case of an automatic or semi-automatic pneumatic threading system a guiding track may be provided as the threading means in the housing bracket and for the air stream conveying the new thread. In both cases it is necessary to register the thread guiding element for the threading procedure spatially with the threading means. For that purpose in many cases the motor shaft is rotated so far while stopping the electric motor by the motor control that the thread guiding element exactly is aligned with the threading means when the motor has stopped. In this case the target rotational position of the motor shaft corresponding to the alignment between the thread guiding element and the threading means will be achieved without the undesirable effect that the motor shaft continues to rotate further in the previous direction of rotation or counter thereto.

It is has been known for a long time to use a permanent magnet motor as the electric motor of a thread supplying device. Due to the design of the permanent magnet motor the rotor shows the tendency even without current supply to stop in one of several stable relative rotational positions when the motor is controlled to stop. The reason is that there occur alternating stable and instable relative rotational positions of the rotor in a permanent magnet motor. If the rotor randomly stops in the region of an instable rotational position then the rotor by itself rotates further without external influences either in the previous direction of rotation or counter thereto in order to find a stable rotational position. The phenomenon of the permanent magnet motor results in problems in a thread supplying device being equipped with a threading means when the motor shaft has to stop in a determined target position in which the thread guiding element is intended to co-act with the threading means.

It is an object of the invention to provide an improved thread supplying device of the kind as disclosed allowing to reliably reproduce target rotational position needed for the threading procedure in stopped condition.

Equipping the thread supplying device with the permanent magnet motor results in the advantage that fewer compromises have to be accepted in view to the operational performance than in case of an asynchronous motor. The permanent magnet motor can be controlled more simply, is compact and can be manufactured for fair costs in series production. The permanent magnet motor has overall the important advantage that it easily can be integrated into computerised data transmission systems and signal transmission systems, respectively, of textile machines. The unavoidable effect of several stable and instable rotational positions of the rotor without current supply due to the design of the permanent magnet motor intentionally is used to retain the thread guiding element in the threading position relatively stably, because the co-operating component group consisting of the stator, the rotor of the permanent magnet motor, the motor shaft and the thread guiding element are mounted in the housing such that one of the stable relative rotational positions of the rotor is the target rotational position of the motor shaft and, consequently, the threading position of the thread guiding element. By this structural measure it is possible to position the thread guiding element during the stop phase of the permanent magnet motor correctly in the threading position and to safely retain it in the threading position without additional means. When preparing the concept of the thread supplying device under consideration of the stable and instable relative rotational positions of the rotor it is necessary to exclude random motor mounting positions but to ensure a predetermined motor mounting position when assembling and designing the thread supply device.

In view to simple manufacturing exclusively the rotational position of the stator in the housing is adapted to the target rotational position corresponding to the threading position of the thread guiding element, provided that there is a fixed interrelation between the motor shaft and the rotor and the thread guiding element. This means that the rotor is fixedly secured on the motor shaft and that thread guiding element is fixedly connected to the motor shaft.

There are, however, several possibilities to avoid the influence of the instable relative rotational positions of the rotor of the permanent magnet motor for the desired threading position of the thread guiding element. The already mentioned rotational positioning of the stator in the housing by means of a positioning device is the first possibility. Alternatively or additively, there even may be provided a rotational positioning device between the rotor and the motor shaft in order to achieve the desired threading position of the thread guiding element correlated to a stable relative rotational position of the rotor, and alternatively or additively even also a rotational positioning device between the thread guiding element and to the motor shaft. The finally selected possibility depends on given structural prerequisites in the thread supplying device.

Expediently, at least one engagement location is provided at the stator. At this engagement location an engaging element of the housing is brought into engagement in order to save the rotational position the stator in the housing such that one of the stable relative rotational positions correlates with the threading position of the thread guiding element.

In view to simple manufacturing the engagement location is formed as a recess or a longitudinal groove in the periphery of the stator. A projection of the housing then is brought into engagement with this engagement location. Expediently, then a locking screw is screwed in assuring the position of the stator.

For assembly reasons the engagement element ought to be provided at the lower side of the housing. In adaptation to that position of the engagement element in the housing the respective engagement location at the stator is placed at an angle of rotation of the rotor which corresponds to in the stable relative rotational position.

Since the rotor takes several stable relative rotational positions within a full revolution, it may be expedient to distribute a number of engagement locations around the circumference, the number corresponding to the number of pole pairs of the stator, and to selectively use one of them for positioning the stator by means of the engagement element.

The threading means may, as known per Se, be constituted by a guiding track in a housing bracket, the guiding track being provided either for a threading needle or for a threading air stream. In the target rotational position of the motor shaft the exit of a winding tube constituting the thread guiding element of the motor shaft will be radially aligned with the guiding track, as soon as the rotor of the permanent magnet motor after switching off the current has taken one of its predetermined stable rotational positions. The control electronics of a permanent magnet motor permanently uses information on the rotational angle of the rotor. This information may be used to move the rotor during a stop of the permanent motor by means of a motor stop routine into the stable relative rotational position correlated to the target rotational position of the motor shaft.

Alternatively or additively, even the position signal of a rotation position sensor of the thread supplying device may be used which provides a confirmation for the motor control that the thread guiding element has reached the threading position.

BRIEF DESCRIPTION OF THE DRAWINGS

Embodiments of the subject of the invention will be explained with the help of the drawings wherein.

DETAILED DESCRIPTION

Figure 1:
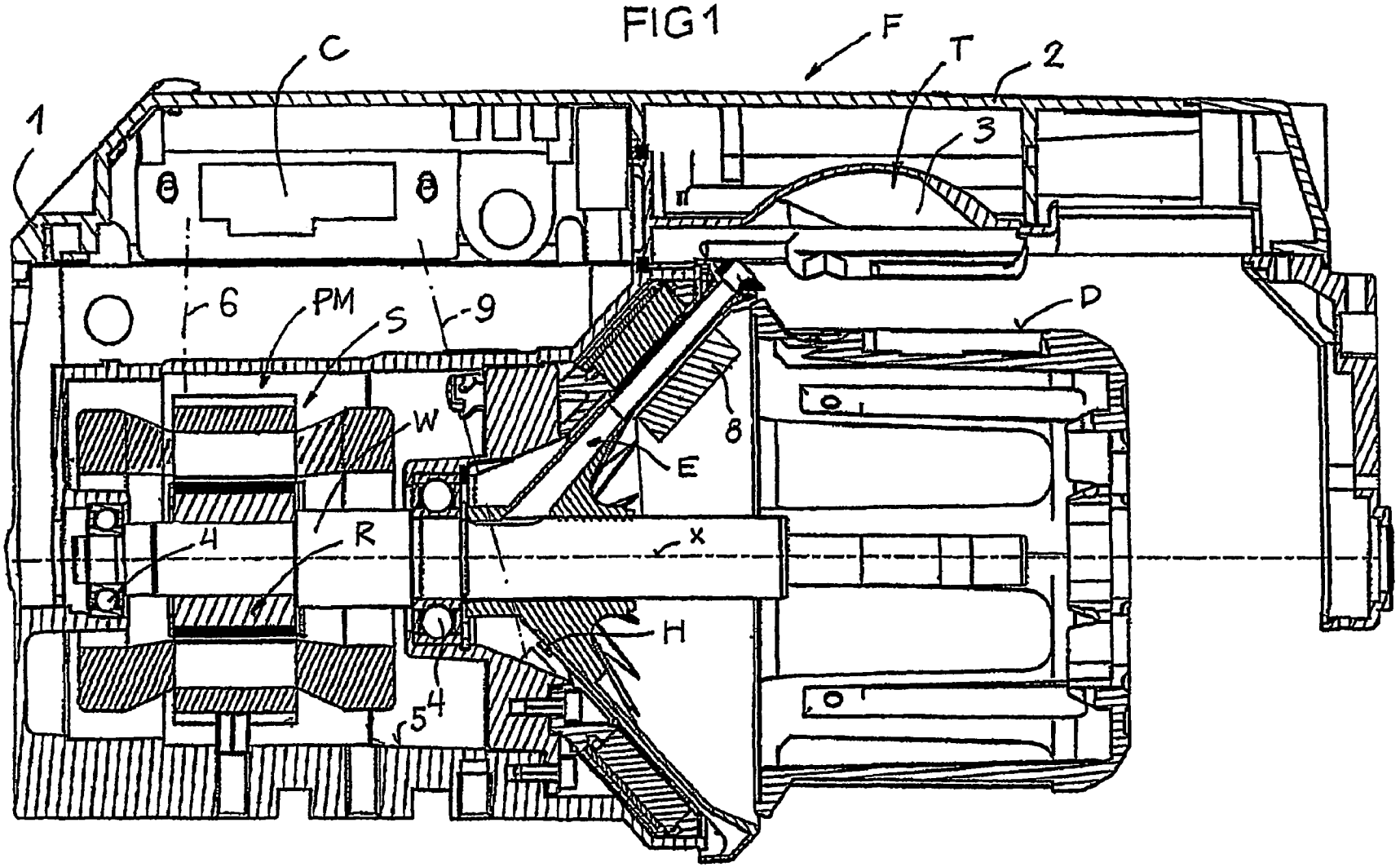
FIG. 1 a longitudinal sectional view of a thread supplying device containing a permanent magnet motor, and FIG. 2 a cross-sectional view of the thread supplying device.
Figure 2:
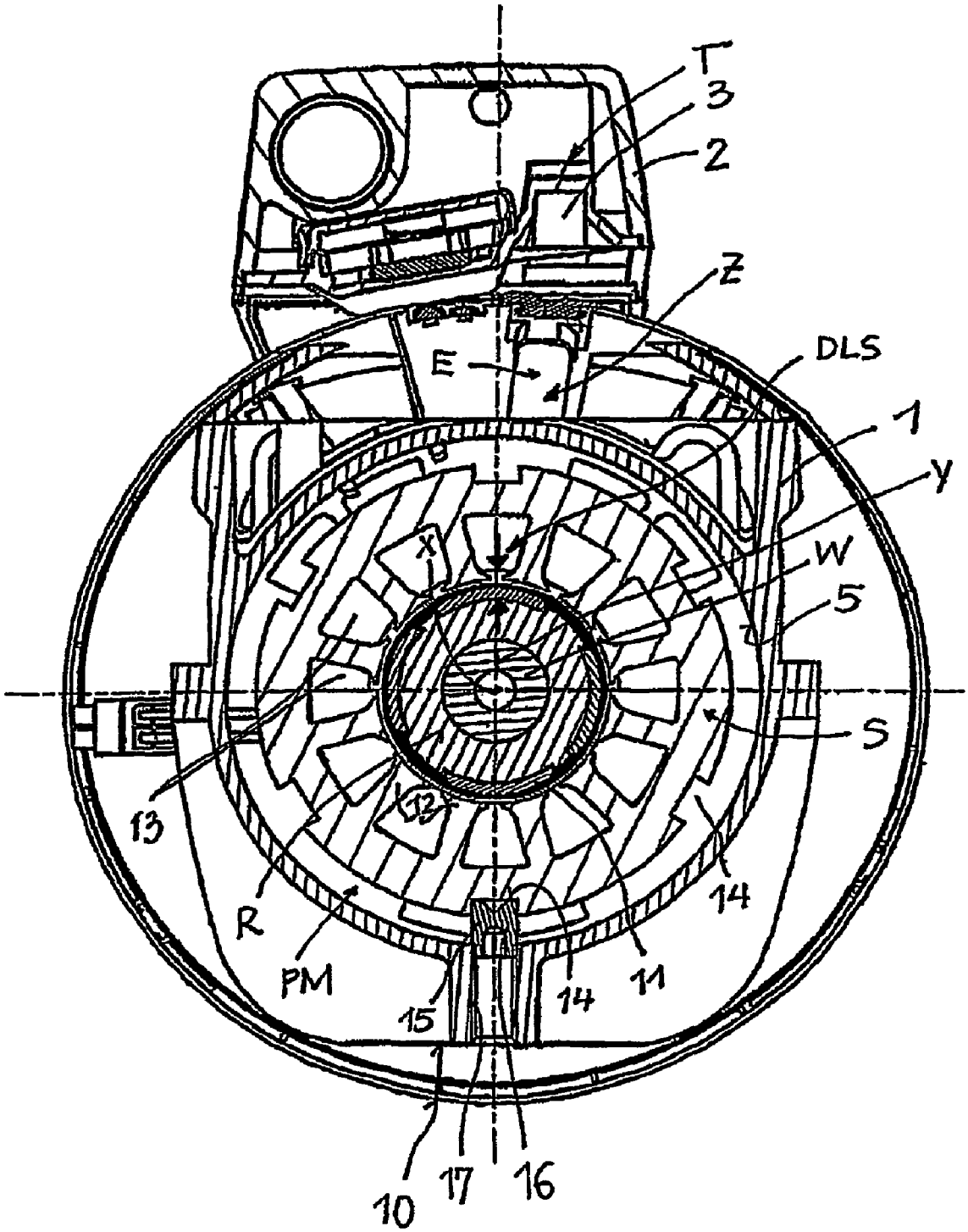

A thread supplying device F as shown in FIGS. 1 and 2 is a weft thread supplying device for a weaving machine. The thread supplying device F has an equipment allowing to manually or automatically or semi-automatically thread in a new thread.

The thread supplying device F has a massive housing 1 and a housing bracket 2. In the lower side of the bracket 2 a guide track 3 is provided constituting a threading means T. The guide track 3 serves either for guiding a threading needle or an air stream conveying a new thread through the thread supplying device F, respectively.

In a cavity 5 of the housing 1 a permanent magnet motor PM is mounted serving as the drive of a thread guiding element E. The thread guiding element E transports a not shown thread coming from the left side through the thread guiding element E to a storage surface of a storage body D in order to form a not shown thread supply. For consumption, the thread in FIG. 1 is withdrawn to the right side.

The permanent magnet motor PM comprises a stator S fixedly mounted in the housing 1 and a rotor R which is arranged inside the stator S on a motor shaft W. The motor shaft is rotatably supported in bearings 4 in the housing 1 and carries the storage body D. A control electronics C is provided in the housing 1 or in the housing bracket 2, respectively, for the permanent magnet motor PM. The control electronics C is connected via a connection 6 to the permanent magnet motor PM. Furthermore, a rotation position sensor H, such as a Hall sensor, may be mounted in the housing 1 to detect at least one rotational position of the thread guiding element E. The rotation position sensor H generates a signal which is transmitted via a connection 9 to the control electronics C, as soon as the thread guiding element E has reached the threading position shown in FIG. 1 in which the thread guiding element E is aligned with the guide track 3 of the threading means T.

The storage body D is rotatably supported in not shown fashion on the motor shaft W for rotation about the axis X of the motor shaft W. The storage body D is hindered from rotating with the motor shaft W by means of permanent magnets 8 provided in the storage body D (stationary storage body). At least the left end section of the motor shaft W is formed as a hollow shaft (not shown). In the shown case the thread guiding element E is integrated into a so-called winding disk and is constituted by a winding tube extending obliquely outwardly from the motor shaft W.

The rotor R fixedly secured to the motor shaft W in FIG. 2 is equipped with several permanent magnets 11 distributed in circumferential direction. The circumferential differences between the permanent magnets 11 may differ from each other. The stator S has pole cores 12 which are distributed in circumferential direction. Cavities 13 arranged between the pole cores 12 are intended to provide not shown windings or coils.

The magnetic co-action between the permanent magnets 11 and the pole cores 12 results in the effect that the rotor R takes either one of several stable relative rotational positions DLS or one of a corresponding number of unstable relative rotational positions within a full revolution, when the current is switched off. Without current supplied to the permanent magnet motor PM the rotor itself rotates from any taken unstable rotational position in uncontrolled fashion in one or the other rotational direction automatically into a stable relative rotational position.

One stable relative rotational position is indicated by the arrows at the locations of DLS. In this stable relative rotational position DLS the motor shaft W has achieved a target rotational position Y. In the target rotational position Y the thread guiding element E is brought into the correct threading position indicated by Z. Then the thread guiding element E is aligned with the threading means T. In order to correlate the stable relative position DLS and the target rotational position Y of the motor shaft W in the threading position Z of the thread guiding element E, which depends from the stable relative rotational position DLS, the stator S of the permanent magnet motor PM is fixed in the housing 1 in FIG. 2 in a precisely predetermined rotational position. For this purpose several engagement locations 14 are distributed about the circumference of the stator. The engagement locations 14 are formed by recesses or longitudinal grooves, respectively. An engagement element 15 of the housing 1 is brought into engagement into one of those engagement locations 14. The engagement element 15 is implemented in this embodiment as a locking screw 16 screwed through a threaded bore 17 provided in the housing 1. The threaded bore 17 expediently, is provided at the lower side 10 of the housing diametrically opposite in relation to the axis X to the housing bracket 2. Each one of the several engagement locations 14 selectively may be used for co-action with the engagement element 15.

In spatial relation to the given position of the threading means T relative to the axis X in FIG. 2, to the target rotational position Y of the motor shaft W when the thread guiding element E is aligned with the threading means T, to the arrangement of the permanent magnets 11 at the rotor R and the positions of the pole core pairs 12 of the stator S, and finally to the selected position of the engagement element 15 in the housing 1, the engagement locations 14 are provided such at the circumference of the stator S that the thread guiding element E will be precisely aligned with the threading means T where simultaneously also the rotor R has taken one of its stable relative rotational positions, e.g. DLS, provided that there is a proper engagement between one engagement location 14 and the engagement element 15.

Since in a permanent magnet motor the control electronics C is informed about the relative angular position of the rotor R in the stator S, a motor stop routine may be programmed for execution by a microprocessor of the control electronics C so as to cause the rotor R to be exactly rotated during stopping of the permanent magnet motor PM such that it precisely reaches the stable relative rotational position DLS in which the thread guiding element E is aligned with the threading means T.

Alternatively or additively, the confirmation signal of the rotation position sensor H may be used as a reference in order to rotate the rotor R during stopping the permanent magnet motor PM into the stable rotational position DLS. In this case the rotation position sensor H can confirm that the motor shaft W has reached the target position Y. Then also the rotor R reaches the determined stable relative rotational position.

In the embodiment shown in FIGS. 1 and 2 the rotational position of the stator S is predetermined such that the above-mentioned results will be achieved. Alternatively it is possible during assembly of the device F to rotate the rotor R in relation to the motor shaft W and then to fix the rotor R on the motor shaft W, when with a given mounting position of the stator S and a desired threading position Z of the thread guiding element one stable relative rotational position DLS of the rotor R is reached. As a further alternative solution it is possible to rotate the thread guiding element E in relation to the motor shaft W and then to fix the thread guiding element E on the motor shaft W when with the actual mounting position of the stator S in the housing 1 the threading position Z is reached at the stable relative rotational position of the rotor R.

The invention claimed is:

1. Thread supplying device comprising a housing containing an electric motor with a motor stator secured against rotation in the housing and a motor rotor fixedly arranged on a rotatably supported motor shaft, a thread guiding element fixedly secured to the motor shaft for co-rotation about an axis of the motor shaft, and a threading means arranged in a fixed position in the housing, the thread guiding element being aligned with the threading means in one target rotational position of the motor shaft in relation to the housing when the motor has stopped, wherein the electric motor is a permanent magnet motor including coils carrying pole cores in the stator and permanent magnets in the rotor, the pole cores and the permanent magnets being arranged to co-act in current-free condition of the permanent magnetic motor such that the rotor is held against rotation by magnetic forces in one of several stable positions relative to the stator, wherein the stator, the rotor and the thread guiding element are arranged relative to the housing and to the axis such that in one of the stable relative rotational positions of the rotor the motor shaft is retained in the target rotational position, and wherein the rotational position of the stator in the housing and one of the stable positions are matched with the target rotational position by a rotation positioning device provided between the housing and the stator.

2. Thread supplying device as in claim 1, wherein the stator has an engagement location at least at one circumferential position of the stator, and wherein the rotation positioning device comprises an engagement element engaging into the engagement location for rotationally positioning the stator in the housing in the matched rotational position of the stator.

3. Thread supplying device as in claim 2, wherein the stator has a number of engagement locations provided at equal circumferential distances in the outer periphery of the stator, the number of engagement locations corresponding to the number of the pole core pairs, and wherein the engagement element engages into one of the engagement locations.

4. Thread supplying device as in claim 1, wherein a recess or longitudinal groove is formed in the outer periphery of the stator, and wherein the rotation positioning device comprises a projection of the housing that is engaged in the recess or the longitudinal groove.

5. Thread supplying device as in claim 4, wherein the projection of the housing is a locking screw.

6. Thread supplying device as in claim 5, wherein the housing includes a housing bracket at an upper housing side, and the locking screw is provided for access from the outside at a lower housing side substantially diametrically opposite to the housing bracket.

7. Thread supplying device as in claim 1, wherein the threading means is constituted by a guide track formed in a housing bracket and wherein the axis of the thread guiding element is aligned with the threading means in the target rotational position, the thread guiding element being formed by a winding tube secured to the motor shaft.

8. Thread supplying device as in claim 1, wherein control electronics of the permanent magnet motor contains a microprocessor for permanently obtaining information on the rotational angle of the rotor in relation to the stator, and wherein the control electronics are equipped with a programmed motor stop routine for stopping the rotor in one of the selected stable rotational positions, which one stable position is correlated to the target rotational position of the motor shaft.

9. Thread supplying device as in claim 1, wherein a rotation position Hall sensor for detecting the rotational position of the motor shaft after the thread guiding element is mounted in the housing and is connected for a reference signal transmission with control electronics of the permanent magnet motor, and wherein the rotation position Hall sensor generates the reference signal used for stopping the rotor in the one stable rotational position that is correlated to the target rotational position of the motor shaft.

10. Thread supplying device comprising:

a housing;

an electric motor disposed inside the housing, the electric motor having a stator secured against rotation with respect to the housing and a rotor fixedly secured to a motor shaft that is supported for rotation relative to the housing about a shaft axis, the electric motor being a permanent magnet motor with the stator having pole cores bearing coils and the rotor having permanent magnets such that the pole cores and the permanent magnets co-act in current free condition of the motor such that the rotor is held against rotation by magnetic forces in one of several stable positions relative to the stator, the stator having an engagement surface located at an outer circumferential position of the stator;

a threading device disposed inside the housing and secured in a fixed position in the housing;

a thread guiding element fixedly secured to the motor shaft for rotation therewith about the shaft axis, the threading device and the thread guiding element being aligned with one another at a single target rotational stop position of the motor shaft in relation to the housing when the motor has stopped; and an engagement element extending between the housing and the stator to engage the engagement surface and position the stator with respect to the housing so that the single target rotational stop position of the motor shaft is matched with one of the several stable positions.

11. Thread supplying device as in claim 10, wherein the engagement element is a locking screw.

12. Thread supplying device as in claim 10, further comprising:

a Hall sensor mounted on the housing to detect the rotational position of the motor shaft; and control electronics adapted to control rotation and stopping of the electric motor and connected to receive a reference signal from the Hall sensor indicative of a rotational position of the motor shaft.

* * * * *